United States Patent [19]

Krüger et al.

[11] 4,400,237

[45] Aug. 23, 1983

[54] PROCESS FOR BLEACHING CELLULOSE WITH ORGANIC PERACID

[75] Inventors: Horst Krüger, Darmstadt; Wilhelm Berndt, Frankfurt; Hans U. Suss, Rodenbach, all of Fed. Rep. of Germany

[73] Assignee: Degussa Aktiengesellschaft, Frankfurt, Fed. Rep. of Germany

[21] Appl. No.: 232,217

[22] Filed: Feb. 6, 1981

[30] Foreign Application Priority Data

Feb. 16, 1980 [DE] Fed. Rep. of Germany ..... 3005947

[51] Int. Cl.[3] ..... D21C 9/16

[52] U.S. Cl. ..... 162/76; 162/78

[58] Field of Search ..... 162/76, 78, 90, 19; 8/111, 107

[56] References Cited

U.S. PATENT DOCUMENTS

| | | | |
|---|---|---|---|
| 2,394,989 | 2/1946 | Dreyfus | 162/76 |
| 2,730,444 | 1/1956 | Hodge et al. | 162/76 |
| 3,193,445 | 7/1965 | Parker et al. | 162/78 |
| 3,867,246 | 2/1975 | Hebbel et al. | 162/76 |

*Primary Examiner*—Steve Alvo

*Attorney, Agent, or Firm*—Cushman, Darby & Cushman

[57] ABSTRACT

Cellulose is bleached by means of an organic peracid in the acid region and subsequently by means of peroxide in the alkaline region. As peracid there is employed an acid which is produced from the corresponding carboxylic acid by reaction with hydrogen peroxide in the presence of a mineral acid. The peroxide bleaching step which follows the peracid bleaching step is carried out after there is added the necessary amount of aqueous alkali solution for carrying out the peroxide bleaching step of the pulp without intermediate washing of the cellulose. A further addition of peroxide is not carried out.

8 Claims, No Drawings

PROCESS FOR BLEACHING CELLULOSE WITH ORGANIC PERACID

BACKGROUND OF THE INVENTION

Chemically obtained cellulose e.g. as it is obtained by the sulfite process or the alkaline sodium or sulfate process still contains besides the chief component cellulose small amount of lignin, hemicelluloses and several other constituents. The mentioned materials accompanying the cellulose, above all the lignin, cause the coloration of the cellulose or the products produced therefrom.

In order to produce paper or other products of high whiteness from the cellulose, which products are not inclined to yellow it is necessary to remove the remaining accompanying materials after the chemical decomposition.

It is known from German Pat. No. 2,219,505 (and related Hebbel U.S. Pat. No. 3,867,246) to bleach in a multiple step process with peroxide and peracid. Thereby the cellulose is bleached, in a given case after an acid pretreatment, in the first step with a peroxide, in the second step with an organic peracid and in the third step with a peroxide. Between the separate bleaching steps the cellulose is washed copiously with water.

A considerable disadvantge of this known process is that for the bleaching with peracid there must be employed an equilibrium peracetic acid. Then in the production of te equilibrium peracid a very high excess of carboxylic acid must be employed in order to shift the equuilibrium as far as possible to the side of peracid. The hydrogen peroxide not reacted to the peracid is lost, namely in the washing of the cellulose subsequent to the peracid bleaching step.

In the known process there is employed an equilibrium peracid in which there is used in its production an 8 to 10 fold excess of carboxylic acid.

Because of the amount of carboxylic acid necessary for this the known bleaching process is uneconomical.

To be sure a reduction of this excess saves carboxylic acid, but leads to a higher residual content of hydrogen peroxide and therefore to a likewise uneconomically high hydrogen peroxide requirement.

A further disadvantage of the process of German Pat. No. 2,219,505 (and the related Hebbel U.S. Pat. No. 3,867,246) is that in using the equilibrium peracid because of thhe slow establishment of the equilibrium large supply vessels are necessary. Thus an average cellulose factory already needs supply vessels having a volume up to 100 $m^3$.

The alternative production of the peracid from carboxylic anhydride as well as the employment of pure peracid for reason of operational safety is not possible because of the dangerousness of concentrated organic per compounds.

Thus in the reaction of carboxylic anhydride with, e.g. hydrogen peroxide, there is formed in addition to the peracid also the dangerous diacylperoxide which is inclined to decompose spontaneously.

Also the production of the peracid from carboxylic acid anhydride and perroxide in the cellulose pulp itself can only be carried out with high peroxide losses because of the dilution which is then present.

SUMMARY OF THE INVENTION

The object of the invention is to develop a process for bleaching cellulose using a peroxide in the alkaline range and an organic peracid in the acid range, in which case a bleaching step with peroxide follows the bleaching step with peracid which is characterized by using a peracid having a hydrogen peroxide content of 10 to 50 weight % and a peracid content of 5 to 40 weight % and which is produced from an organic carboxylic acid having a concentration of 50 to 100 weight %, preferably 90 to 100 weight %, by reaction with hydrogen peroxide of a concentration of 30 to 90 weight %, preferably 50 to 70 weight %, in the presence of a mineral acid at a temperature between 20° and 100° C., preferably 50° to 80° C., after the acid bleaching step with the organic peracid the cellulose is not washed, there is added the necessary amount of alkali in the form of an aqueous solution to carry out the alkaline bleaching step with peroxide and the bleaching is carried out without further addition of peroxide. As mineral acids there can be used sulfuric acid, phosphoric acid and nitric acid.

The mineral acid need only be used in catalytic amount, e.g. 0.3 to 5.0% of the carboxylic acid.

Illustrative alkalis are sodium hydroxide and potassium hydroxide.

In the process the excess of peroxide remaining from the acid peracid bleaching step can be used for the peroxide bleach.

As carboxylic acids there are used, for example, lower alkannoic acids such as acetic acid or propionic acid.

The amount of peracid can be 0.1 to 5.0 weight % and the peroxide 0.2 to 3.0 weight % based on the bone dry cellulose. The temperature in the bleaching steps can be between 30° and 140° C., preferably between 40° and 90° C., the pulp consistency in the peracid bleaching step can be between 5 and 30%, preferably 10 to 15% based on the bone dry cellulose.

With cellulose difficult to bleach the bleaching step sequence peracid/peroxide can be repeated. However, it is also possible before the bleaching sequence peracid/peroxide to carry out an additional alkaline peroxide bleaching step.

There can also be carried out additional known bleaching steps, such as, e.g. with hypochlorite or chlorine, dioxide in connection with the bleaching process of the invention.

Because of the process of the invention the chloride free waste water after the peroxide bleaching step can be evaporated and burning carried out, thereby it is possible to recover the carboxylic acid used for the production of peracid in the evaporation after the neutralization of the waste water.

The process of the invention can be carried out in a bleaching tower suitable for displacement bleaching, in a given case with repetition, whereby the displaced peracid solution after mixing with alkali again is supplied to the bleaching tower for the peroxide bleach.

The elimination of the washing of the cellulose after the peracid step permits the utilization of the entire content of the pulp with hydrogen peroxide for the further bleaching (after alkalizing by the addition of aqueous sodium hydroxide solution). This means that an equilibrium percarboxylic acid even with high peroxide content can be used economically, or that it is not necessary to wait for establishment of an equilibrium.

Because of this on the one hand it is possible to operate with considerably lesser amounts of carboxylic acid and on the other hand there can also be used very much smaller reactors for the production of the amounts of peracid needed in the bleaching. These can then be operated in flow through which additionally contributes to the safety of the process. Thus for example there can be produced for a 200 yearly ton cellulose factory having a requirement of 1% peracid at suitable carrying out of the reaction 2 ons of peracetic acid with only 2.5 tons of glacial acetic acid in a flow thrugh reaction containing only about 300 l/h. (The term "ton" here and elsewhere in the specification refers to metric tons.)

Thereby indeed only half of the hydrogen peroxide employed is reacted to the peracid. The hydrogen peroxide not reacted, however, is effectively used through the process of the invention for further bleaching of cellulose.

Unless otherwise indicated all parts and percentages are by weight.

The process can comprise, consist essentially of or consist of the steps set forth with the stated materials.

DETAILED DESCRIPTION

Example 1

There was bleached a medium hard spruce sulfite paper cellulose (18.5 kappa) in three steps to a whiteness content of about 88 (Elrepho F 6) with the bleaching sequence P-PES-P (peroxide-peracid-peroxide). The percent numbers are weight percent.

(a) According to the process described in German Pat. No. 2,219,505 (and Hebbel U.S. Pat. No. 3,867,246):

| |
|---|
| Step 1. 2,2% $H_2O_2$ |
| 2,2% NaOH 1,5 hours 18% pulp consistency 60° C. |
| Washing |
| Step 2. 1,0% Peracetic acid (employed as 10% equilibrium peracid) |
| 1 hour 12% pulp consistency 60° C. |
| Washing |
| Step 3. 1,0% $M_2O_2$ |
| 2,0% NaOH 2,5 hours 12% pulp consistency 60° C. |
| Washing |

(b) According to the process of the invention

| |
|---|
| Step 1. 2,2% $H_2O_2$ |
| 2,2% NaOH 1,5 hours 18% pulp consistency 60° C. |
| Washing |
| Step 2. 1,0% $H_2O_2$ |
| 1,0% Peracetic acid |
| 1 hour 12% pulp consistency 60° C. |
| No washing but intermixing |
| Step 3. 2,2% NaOH 2,5 hours 10% pulp consistency 60° C. |
| Washing |

There is obtaned according to (a) a whiteness content of 88.7; according to (b) a whiteness content of 88.4.

For the bleaching of 100 kg of cellulose according to variant (a) in using a commercial 10% peracetic acid solution there were needed 8.5 kg of glacial acetic acid.

In contrast if there is employed according to the process of the invention (variant (b)) a mixture of $H_2O_2$ and peracetic acid (1:1) which was obtained by reaction of $H_2O_2$ (70%) with glacial acetic acid in the presence of a catalytic amount of sulfuric acid 1% of the acetic acid at 60° C. and one hour reaction time, then there is needed for the bleaching of 100 kg of cellulose only 1.25 kg of glacial acetic acid.

Example 2

Here there was bleached a beech sulfite synthetic fiber cellulose with the bleaching sequence PES-P-H (peracid-peroxide-hypochlorite). The percentages given are weight percent.

(a) According to the process described in German Pat. No. 2,219,505 (and the Hebbel U.S. patent):

| |
|---|
| Step 1. 0,5% Peracetic acid 1 hour 12% pulp consistency 70° C. |
| Washing |
| Step 2. 0,8% $H_2O_2$ |
| 6,0% NaOH 1,5 hour 10% pulp consistency 80° C. |
| Washing |
| Step 3. 0,4% NaOCl 3,0 hour 10% pulp consistency 40° C. |
| Washing |

(b) According to the process of the invention

| |
|---|
| Step 1. 0,5% Peracetic acid 1 hour 12% pulp consistency 70° C. |
| No washing but intermixing |
| Step 2. 6,0% NaOH 1,5 hour 10% pulp consistency 80° C. |
| Washing |
| Step 3. 0,4% NaOCl 3 hours 10% pulp consistency 40° C. |
| Washing |

| Results | Variant (a) | Variant (b) |
|---|---|---|
| Whiteness content (Elrepho F 6) | 91,4 | 91,5 |
| —Cellulose % | 90,9 | 90,3 |
| Viscosity (mp) | 126 | 128 |

There resulted a considerable saving of acetic acid according to the process of the invention. In variant (a) using a 10% equilibrium peracetic acid there were needed for bleaching 100 kg of cellulose 4.25 kg of acetic acid.

According to the process of the invention (variant (b)) for the bleaching of 100 kg of cellulose there was needed a $H_2O_2$/peracetic acid mixture (1,6:1) of $H_2O_2$ (50%) and glacial acetic acid in the presence of a catalytic amount of sulfuric acid 1% of the acetic acid at 60° C. and a reaction time of 1 hour with only 0.88 kg of acetic acid.

What is claimed is:

1. A process for the bleaching of cellulose using peroxide in the alkaline range and an organic percarboxylic acid in the acid range werein a bleaching step with peroxide follows the bleaching step with the percarboxylic acid comprising (1) carrying out the bleaching with aqueous percarboxylic acid containing 5 to 40 weight % of percarboxylic acid and 10 to 50 weight % hydrogen peroxide, said percarboxylic acid having been produced from an organic carboxylic acid having a concentration of 50 to 100 weight % by reaction with 30 to 90 weight % hydrogen peroxide in the presence of a mineral acid at a temperature between 20° and 100° C. and (2) adding to the cellulose immediately after the percarboxylic acid bleaching step and without an intermediate washing an amount of aqueous alkali needed for carrying out an alkali bleaching step with said peroxide and then carrying out the peroxide bleaching without further addition of peroxide with said hydrogen peroxide.

2. A process according to claim 1 wherein the carboxylic acid has a concentration of 90 to 100 weight %, the hydrogen peroxide has a concentration of 50 to 70 weight % and the temperature is 50° to 80° C.

3. A process according to claim 1 wherein the carboxylic acid is a lower alkanoic acid.

4. A process according to claim 3 wherein the lower alkanoic acid is acetic acid or propionic acid.

5. A process according to claim 4 wherein the lower alkanoic acid is acetic acid.

6. A process according to claim 1 wherein there is employed 0.1 to 5.0 weight % of acetic acid or propionic acid and 0.2 to 3.0 weight % of peroxide based on the bone dry cellulose, the temperature in the bleaching step is 30° to 140° C. and the pulp consistency is 5 to 30% in the percarboxylic acid bleaching step based on the bone dry cellulose.

7. A process according to claim 6 wherein the carboxylic acid has a concentration of 90 to 100 weight %, the hydrogen peroxide has a concentration of 50 to 70 weight % and the temperature is 50° to 80° C.

8. A process according to claim 7 wherein the temperature in the bleaching step is between 40° and 90° C. and the pulp consistency in the percarboxylic acid bleaching step is 10 to 15% based on the bone dry cellulose.

* * * * *